US011369247B2

(12) United States Patent
Stevens et al.

(10) Patent No.: US 11,369,247 B2
(45) Date of Patent: Jun. 28, 2022

(54) WARE WASHING MACHINE WITH HEAT PUMP AND MODULATING VALVE

(71) Applicant: Ali Group North America Corporation, Vernon Hills, IL (US)

(72) Inventors: Kenneth Ward Stevens, King, NC (US); James Lee Davis, Winston Salem, NC (US)

(73) Assignee: Ali Group North America Corporation, Vernon Hills, IL (US)

( * ) Notice: Subject to any disclaimer, the term of this patent is extended or adjusted under 35 U.S.C. 154(b) by 0 days.

(21) Appl. No.: 16/942,005

(22) Filed: Jul. 29, 2020

(65) Prior Publication Data

US 2021/0100422 A1 Apr. 8, 2021

Related U.S. Application Data

(60) Provisional application No. 62/909,562, filed on Oct. 2, 2019.

(51) Int. Cl.

| | |
|---|---|
| ***A47L 15/42*** | (2006.01) |
| ***A47L 15/00*** | (2006.01) |
| ***A47L 15/24*** | (2006.01) |

(52) U.S. Cl.

CPC ..... *A47L 15/0028* (2013.01); *A47L 15/0076* (2013.01); *A47L 15/24* (2013.01); *A47L 15/4217* (2013.01); *A47L 15/4219* (2013.01); *A47L 15/4285* (2013.01); *A47L 2501/01* (2013.01); *A47L 2501/03* (2013.01); *A47L 2501/06* (2013.01); *A47L 2501/10* (2013.01)

(58) Field of Classification Search

CPC ..... A47L 15/0047; A47L 15/0076; A47L 15/078; A47L 15/24; A47L 15/247; A47L 15/4285; A47L 15/4287; A47L 15/4214; A47L 15/4219; A47L 15/4291; A47L 15/48; A47L 15/483; A47L 2401/00; A47L 2401/03; A47L 2401/07; A47L 2401/34; A47L 2501/00; A47L 2501/01; A47L 2501/03; A47L 2501/06; A47L 2501/10

See application file for complete search history.

(56) References Cited

U.S. PATENT DOCUMENTS

| | | | | |
|---|---|---|---|---|
| 5,231,722 A * | 8/1993 | Shacklock | ..... | D06F 34/08 68/12.22 |
| 2017/0027404 A1 * | 2/2017 | Anim-Mensah | ..... | F25B 39/00 |

* cited by examiner

*Primary Examiner* — David G Cormier
(74) *Attorney, Agent, or Firm* — Coats & Bennett, PLLC

(57) ABSTRACT

A conveyor type ware washing machine uses a heat pump to reduce exhaust heat and to heat incoming water. A modulating valve is used to control incoming water flow through a heat exchanger of the heat pump. Processing circuitry automatically dynamically adjusts the modulating valve between a plurality of open states based on the sensed refrigerant head pressure of the heat pump, so that the refrigerant head pressure is maintained in a predefined range. The ware washing machine is efficient, and reduces the amount of heat exhausted to ambient. Related methods are also disclosed.

20 Claims, 6 Drawing Sheets

WARE WASHING MACHINE WITH HEAT PUMP AND MODULATING VALVE

This application claims the benefit of U.S. Provisional Application No. 62/909,562, filed 2 Oct. 2019, the disclosure of which is incorporated herein by reference in its entirety.

BACKGROUND

The present invention is generally directed to food dishware washing devices, and more particularly to a device that washes wares with an improved energy efficiency and/or better operation, and related methods.

Restaurants and other food service establishments typically employ numerous devices to clean their plates, cups, glasses, utensils, and the like, collectively referred to in the art as "dishware" or simply "wares". One common example is a dishwashing machine. While dishwashing machines are also found in household settings, commercial dishwashing equipment differs in that they are typically faster and must meet numerous additional requirements, such as those dictated by health codes. Faster cleaning allows the food service establishment to have a lower inventory of wares, which takes up less physical space and lowers operating costs. However, health codes typically require that each piece of ware be rinsed by at least a certain minimum amount of water at or above a certain temperature (such as 180° F.), with the intent being that the surfaces of the ware will therefore necessarily reach at least a certain temperature in order to kill any bacteria that may be present thereon.

The use of hot water for rinsing tends to create hot moist air, sometimes referred to as steam, in the ware rinse area. Many typical ware washing machines allow this steam to enter the surrounding kitchen when the washing machine door is opened. Other ware washing machines employ a continuously-on exhaust fan to exhaust the steam into the surrounding kitchen. Further still, many ware washing machines are required to be placed under continuously running vent hoods so that the escaping steam may be vented outside the building. However, all of these approaches have proven less than satisfactory, primarily due to their excess energy consumption. As such, there remains a need for alternative approaches to ware washing machines and related methods, particularly approaches that result in better overall energy consumption and/or better operation.

SUMMARY

The present disclosure is generally directed to a conveyor type ware washing machine, and related methods, that use a heat pump to reduce exhaust heat and to heat incoming water. A modulating valve is used to control incoming water flow through a heat exchanger of the heat pump. Processing circuitry automatically dynamically adjusts the modulating valve between a plurality of open states based on the sensed refrigerant head pressure of the heat pump, so that the refrigerant head pressure is maintained in a predefined range. The ware washing machine is efficient, and reduces the amount of heat exhausted to ambient.

In one or more embodiments, the present disclosure relates to a ware washing machine that includes a ware washing cavity, a wash tank, a heat pump, a sensor, an inlet fluid conduit, a modulating valve, and processing circuitry. The heat pump includes a first heat exchanger, an evaporator section, and a condensing section. The first heat exchanger is disposed in an exhaust air plenum leading from the ware washing cavity and is operative to remove heat from the exhaust air to heat incoming water. The evaporator section has a second heat exchanger disposed in the exhaust air plenum downstream of the first heat exchanger, and operative to further remove heat from the exhaust air. The heat pump, when operating, has a refrigerant head pressure that varies based on a load placed on the heat pump. The sensor is operative to sense the refrigerant head pressure. The inlet fluid conduit is downstream from the first heat exchanger and leads to the wash tank. The modulating valve is disposed along the inlet fluid conduit and is operative to control flow through the inlet fluid conduit. The processing circuitry is operatively connected to the sensor and the modulating valve. The processing circuitry is configured to automatically dynamically adjust the modulating valve between a plurality of open states based on the sensed refrigerant head pressure, so that the refrigerant head pressure is maintained in a predefined range.

In one or more other embodiments, the disclosure relates to a method of controlling a ware washing machine. The ware washing machine includes: 1) a ware washing cavity; 2) a wash tank; 3) a heat pump having a first heat exchanger disposed in an exhaust air plenum leading from the ware washing cavity and operative to remove heat from exhaust air flowing through the exhaust air plenum to heat incoming water; the heat pump, when operating, having a refrigerant head pressure that varies based on a load placed on the heat pump; 4) a sensor operative to sense the refrigerant head pressure; 5) an inlet fluid conduit downstream from the first heat exchanger and leading to the wash tank; 6) a modulating valve disposed along the inlet fluid conduit and operative to control flow through the inlet fluid conduit; and 7) processing circuitry operatively connected to the sensor and the modulating valve. The method includes automatically dynamically adjusting the modulating valve between a plurality of open states based on the sensed head pressure, so that the head pressure is maintained in a predefined range.

The features, functions, and/or advantages that have been discussed can be achieved independently in various embodiments or may be combined in yet other embodiments, further details of which can be appreciated with reference to the following description and the drawings

DESCRIPTION

Figure 1:
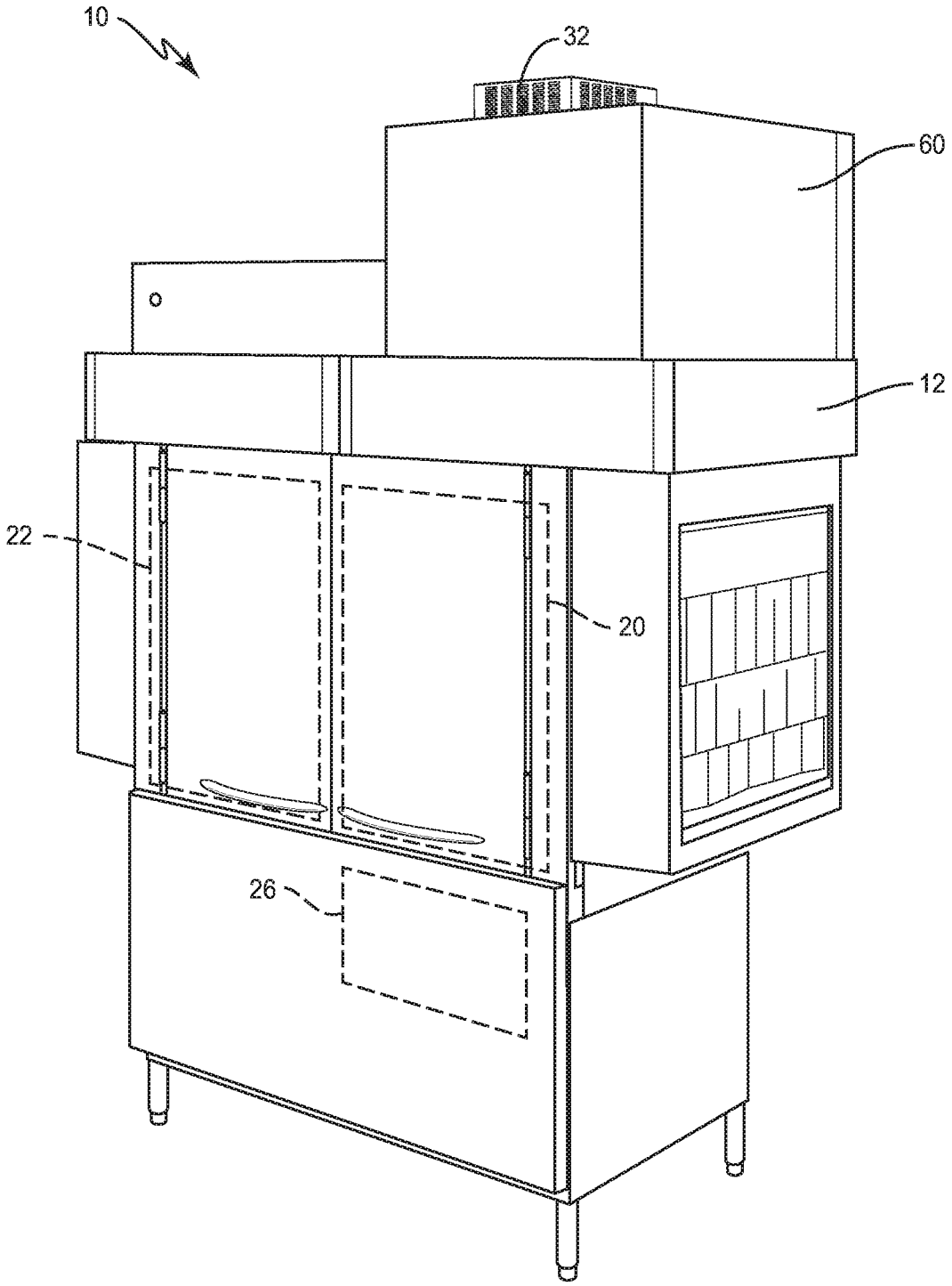
FIG. 1 shows a front perspective view of a ware washing machine according to one or more embodiments.
Figure 2:
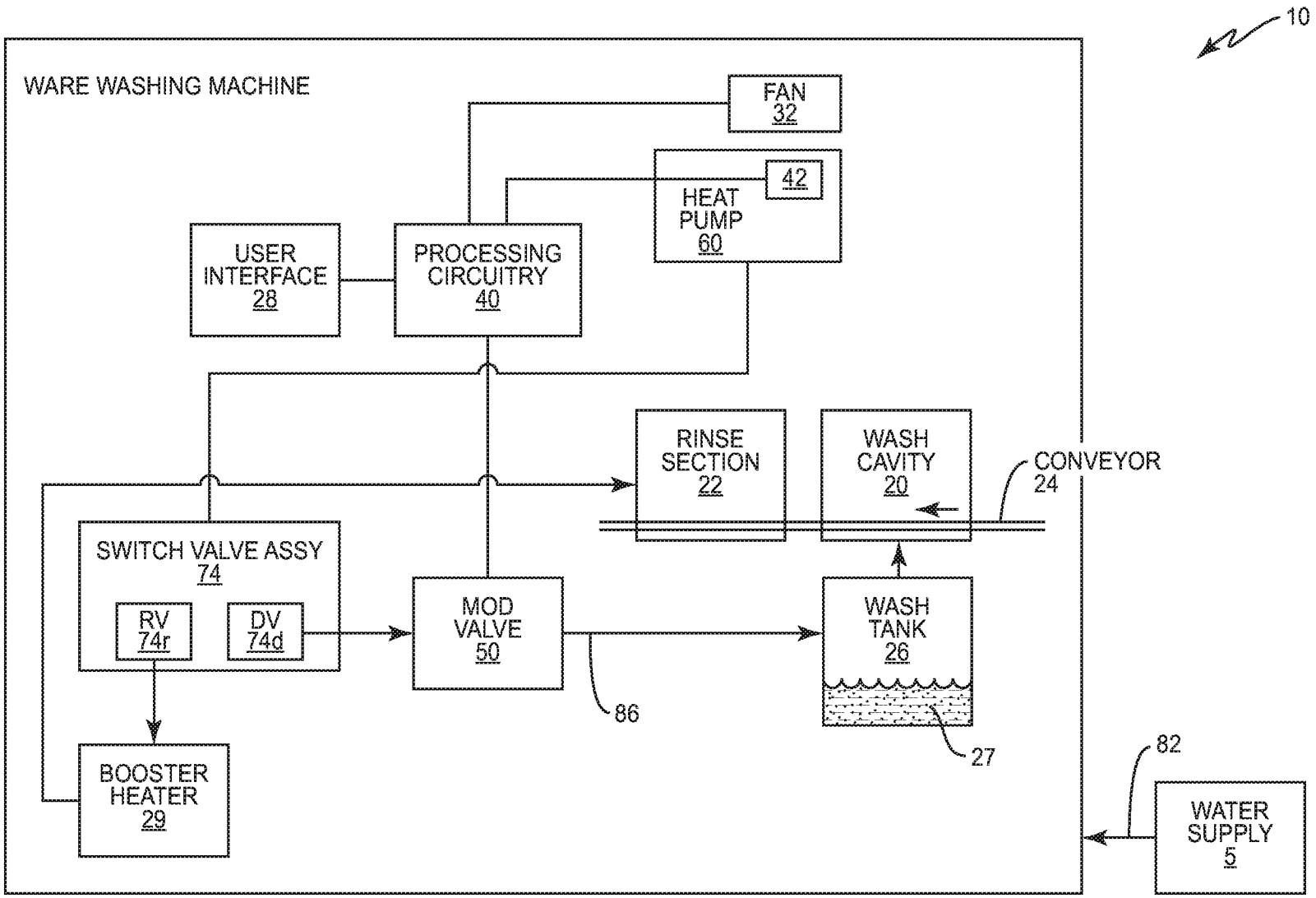
FIG. 2 shows a simplified schematic of the ware washing machine of FIG. 1.
Figure 3:
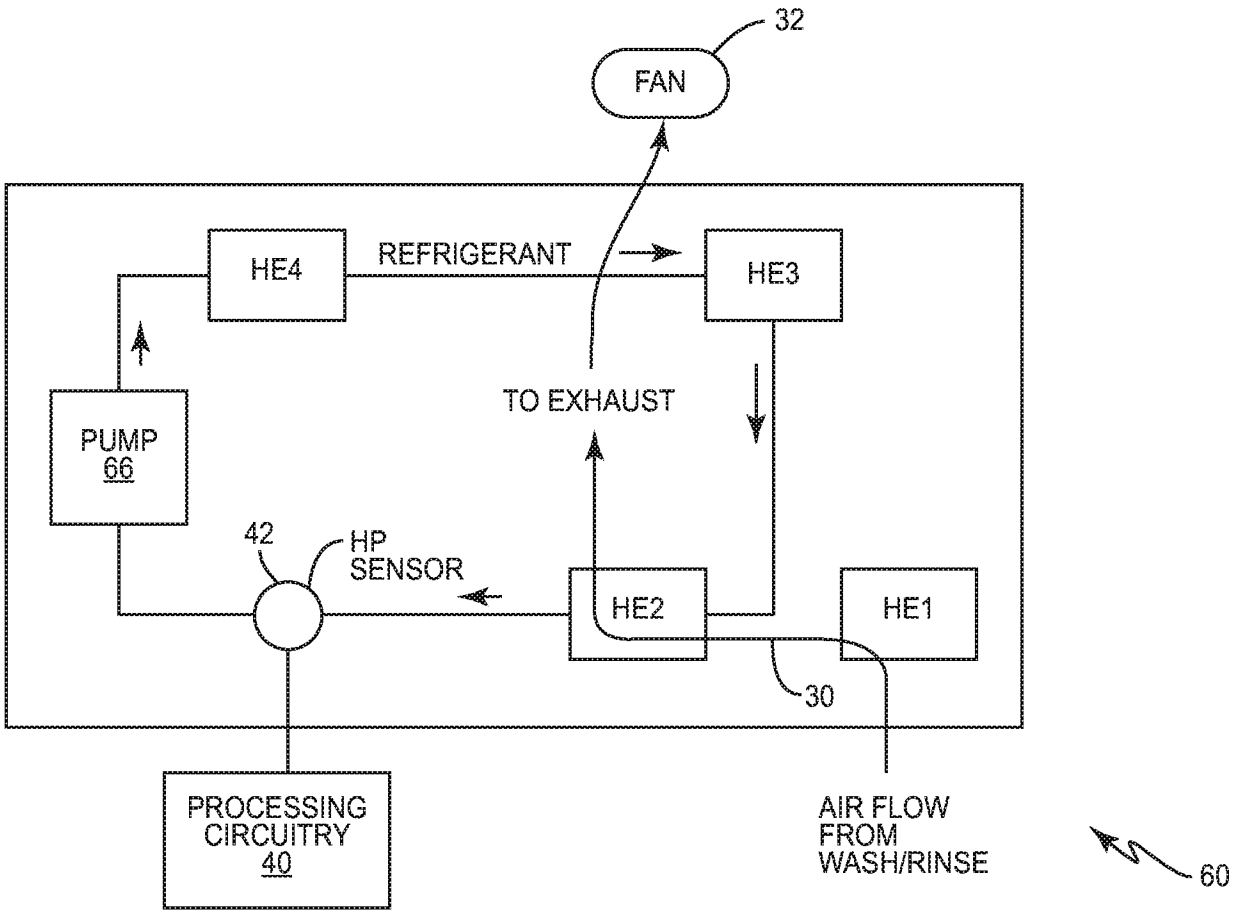
FIG. 3 shows a simplified schematic of a heat pump of FIG. 2.
Figure 4:
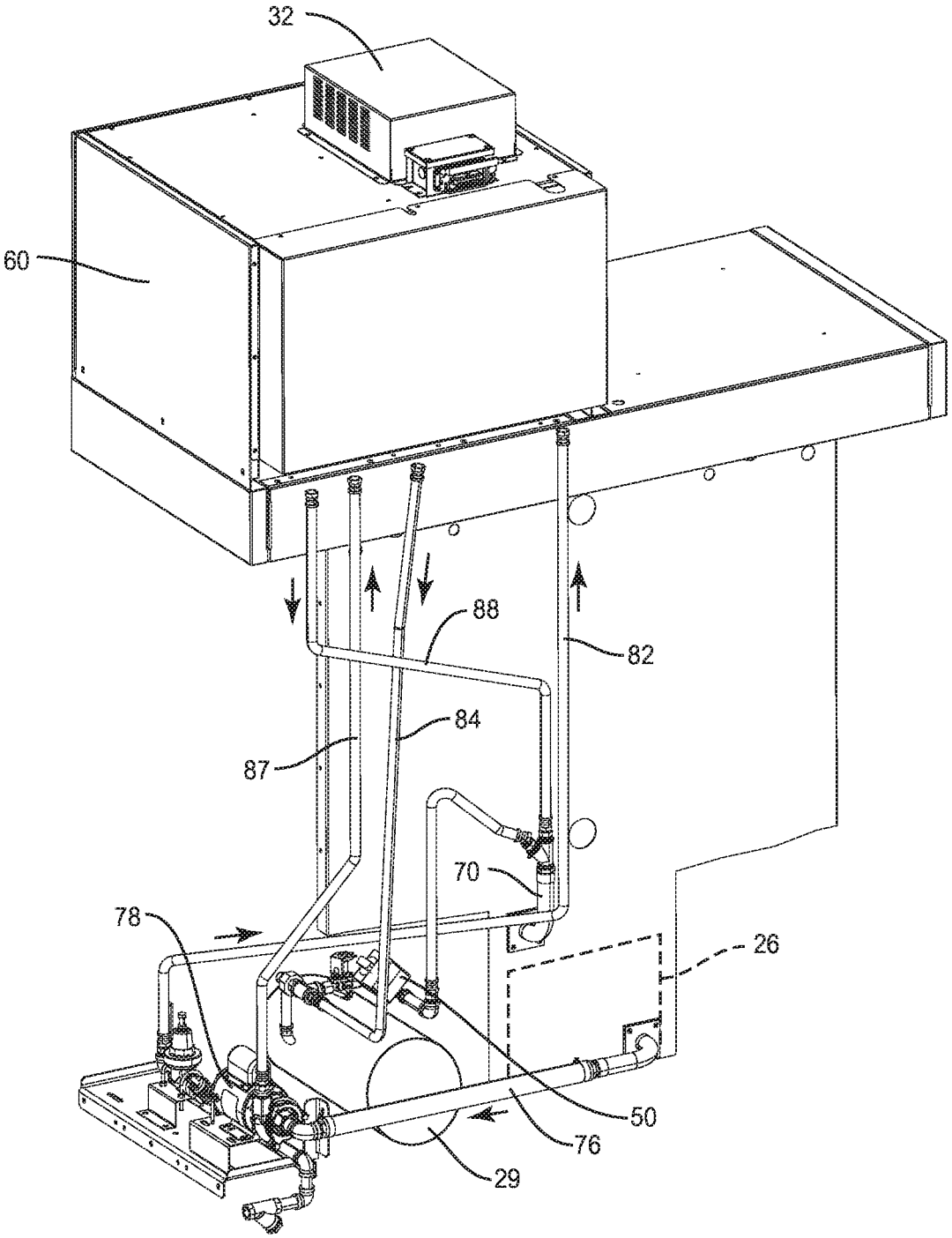
FIG. 4 shows a rear perspective view of the ware washing machine of FIG. 1, with portions of the housing thereof removed.
Figure 5:
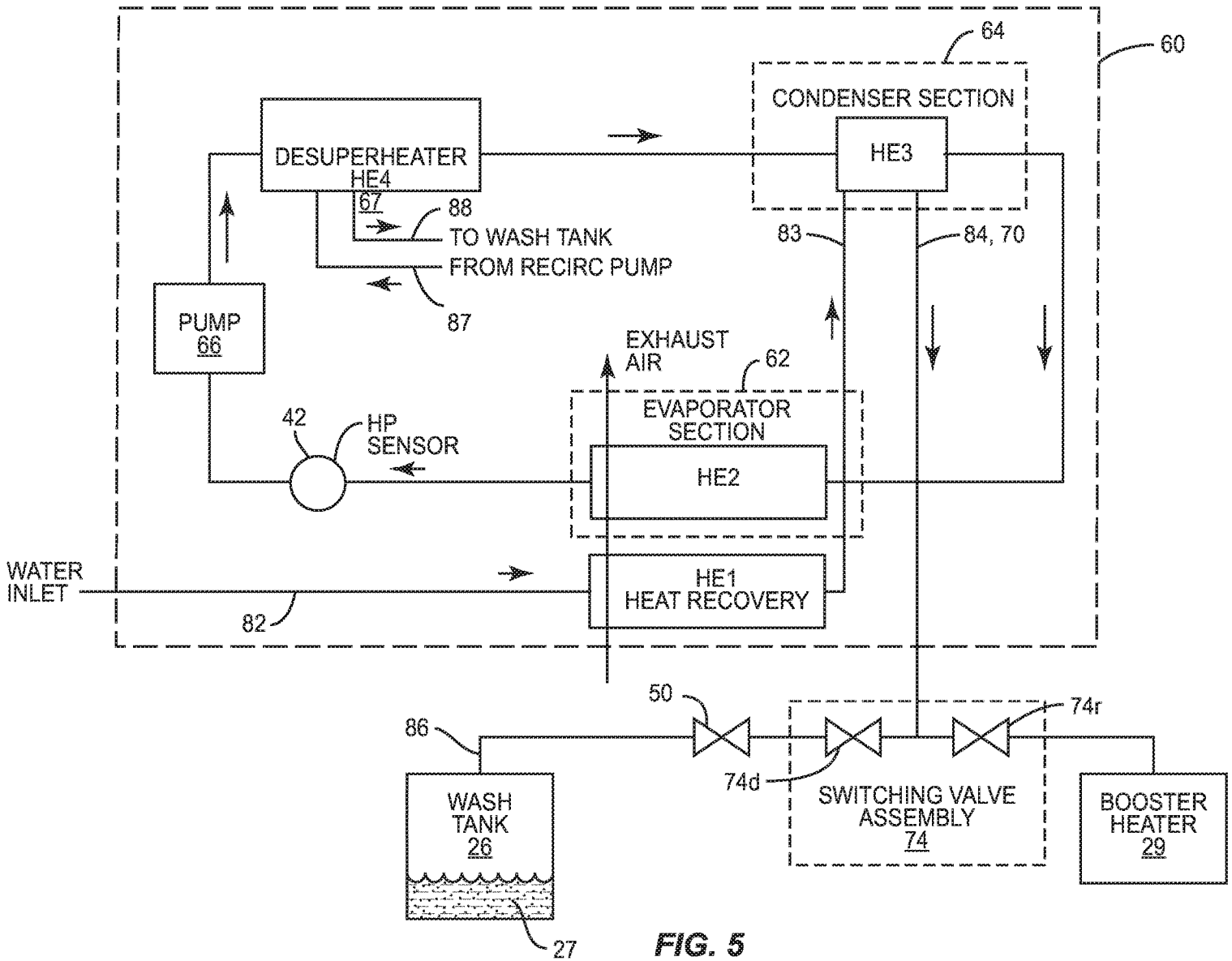
FIG. 5 shows a simplified schematic of the ware washing machine of FIG. 1.

The present invention relates to a conveyor type ware washing machine, generally indicated at 10, and related methods. In general, the ware washing machine 10 includes a ware washing cavity 20, a rinse section 22, a conveyor 24 that transports "racks" of wares through the ware washing cavity 20 and through the rinse section 22, processing circuitry 40, a user interface 28, an optional booster heater 29, and a heat pump 60. One function of the ware washing machine 10 is to provide hot water with detergent to the ware washing cavity 20, where the wares are cleaned. The hot water with detergent is provided from a reservoir referred to as a wash tank 26. In order to provide hot water to replenish the wash tank 26, incoming fresh water (which is typically around 70° F.) needs to be heated. The present invention routes the incoming water through heat pump 60 to heat the incoming water. In addition, the heat pump 60 allows the "steamy" exhaust from the ware washing cavity 20 and/or the rinse section 22 to be cooled before being released to the ambient environment (e.g., the kitchen space).

Referring to FIGS. 1-5, a ware washing machine 10 according to one or more illustrative embodiments includes a housing 12 enclosing a ware washing cavity 20, a wash tank 26, a rinse section 22; a heat pump 60; a sensor 42 operative to sense refrigerant head pressure; a modulating valve 50; and processing circuitry 40. As discussed further below, the processing circuitry 40 is operatively connected to the sensor 42 and configured to, when in a wash or first mode, automatically dynamically adjust the modulating valve 50 based on the sensed refrigerant head pressure, so that the refrigerant head pressure is maintained in a predefined range.

The ware washing cavity 20 is where the wares are washed with a solution 27 of warm water and detergent, with the solution 27 typically directed at the wares under pressure. The solution 27 of warm water and detergent is supplied from the wash tank 26, which may advantageously be disposed below the ware washing cavity 20. The rinse section 22 is where the washed wares are rinsed with hot clean water (again, typically under pressure) so as to remove residual solution 27. The rinsing occurs with at least a certain minimum amount of water at or above a certain temperature (such as 180° F.), with the intent being that the surfaces of the ware will therefore necessarily reach at least a certain temperature in order to kill any bacteria that may be present thereon. An optional booster heater 29 heats the rinse water as necessary for supply to the rinse section 22. A conveyor 24 transports "racks" of wares through the ware washing cavity 20 and through the rinse section 22, and typically extends some both upstream of the ware washing cavity 20 and downstream of the rinse section 22 to facilitate loading and unloading of the racks. The processing circuitry 40 controls the operation of the ware washing machine 10, and may take any suitable form such as a microprocessor, a programmable logic controller, discrete electronics, and/or a combination thereof. A user interface 28 allows the user to input control information (e.g., start, etc.) and optionally displays relevant information, such as faults, to the user.

As can be appreciated, the use of hot water for washing and/or rinsing tends to create hot moist air, sometimes referred to in the art as steam, in the ware washing machine 10. This steam carries heat that the ware washing machines 10 of the present disclosure employ to heat incoming water, using heat pump 60. The heat pump 60 includes advantageously three or more heat exchangers. A first heat exchanger HE1 functions as a heat recovery unit which transfers heat from the warm exhaust to the incoming water. The first heat exchanger HE1 is disposed in an exhaust air plenum 30 leading from the ware washing cavity 20 and/or rinse section 22, and receives both the warm moist exhaust from the ware washing cavity 20 and/or rinse section 22, and relatively cool inlet water from water supply 5. A second heat exchanger HE2 is disposed in an evaporator section 62 of the heat pump 60 and further cools the exhaust by transferring heat from the partially cooled exhaust to the refrigerant of the heat pump 60. A third heat exchanger HE3 is disposed in a condensing section 64 of the heat pump 60 and transfers heat from the refrigerant in the condensing section 64 of the heat pump 60 to the partially heated incoming water from the first heat exchanger HE1. In some embodiments, a fourth heat exchanger HE4 transfers heat from a desuperheater 67 of the heat pump 60 to water being recirculated to the wash tank 26. As is conventional in a heat pump 60, refrigerant is routed through a closed path, and is condensed at condensing section 64 (thereby heating the refrigerant) and routed to evaporator section 62 where the refrigerant is allowed to expand (thereby cooling the refrigerant). Thus, the refrigerant is heated and cooled as it flows through its closed route. For the ware washing machines 10 of the present disclosure, the evaporator section 62 of the heat pump 60 is associated with the second heat exchanger HE2, and the condensing section 64 is advantageously associated with the third heat exchanger HE3.

As is conventional in a heat pump 60, when the heat pump 60 is operating, the refrigerant has a head pressure as it is pumped through its closed route, which is typically measured on either side of pump 66 which pumps refrigerant through the heat pump 60. A sensor 42 is provided to measure the head pressure of the refrigerant so that the head pressure may be supplied to the processing circuitry 40, so that the processing circuitry 40 can take appropriate actions.

Water is routed through the ware washing machine 10 by a plurality of lines, starting with water supply line 82. Water supply line 5 leads from a water supply 5 (e.g., so-called "wall water," which is typically "cold", e.g., about 70° F.) to the first heat exchanger HE1. Line 83 extends from the first heat exchanger HE1 to the third heat exchanger HE3. Line 84 leads from the third heat exchanger HE3 to a switching valve assembly 74. An inlet fluid conduit 70 is disposed downstream from the first heat exchanger HE1 and leads to the wash tank 26. The inlet fluid conduit 70 includes the combination of line 84 and line 86 toward wash tank 26. Modulating valve 50 is disposed along the inlet fluid conduit 70, and is operative to control flow through the inlet fluid conduit 70. The modulating valve 50 is electronically controlled and operates under control of the processing circuitry 40, as is explained further below. The modulating valve 50 has a closed state (fully blocking flow through the inlet fluid conduit 70), and a plurality of open states corresponding to different amounts of flow through the inlet fluid conduit 70.

The processing circuitry 40 is operatively connected to the sensor 42 and to the modulating valve 50. The processing circuitry 40 is configured to automatically dynamically adjust the modulating valve 50 between a plurality of open states based on the sensed refrigerant head pressure, so that the refrigerant head pressure is maintained in a predefined range. The predefined range may be any suitable range for safely and efficiently operating the heat pump 60, such as between about 250 psi and about 285 psi. In some embodiments, the processing circuitry 40 is configured to dynamically adjust the modulating valve 50 using a proportional-integral-derivative control algorithm. In some embodiments, the control of the modulating valve 50 is periodically performed, while in other embodiments the control of the modulating valve 50 is considered to be continuous when water is flowing through the modulating valve 50.

The modulating valve 50 is dynamically controlled while heated inlet water is being supplied to the wash tank 26 so that the load on the heat pump 60, and thus the heat pump's head pressure, can be controlled within desired limits. When more fresh heated water is supplied to the wash tank 26 there is a corresponding greater flow through the modulating valve 50, and thus the inlet fluid conduit 70 and the first heat exchanger HE1 and the third heat exchanger HE3. In such a situation, more heat is removed from the exhaust at the first heat exchanger HE1, so there is less heat in the exhaust from the ware washing cavity 20 and/or rinse section 22 at the second heat exchanger HE2, and therefore a lesser load on the refrigerant recirculation pump 66 of the heat pump 60, resulting in lower head pressure. When less fresh heated water is supplied to the wash tank 26, there is a corresponding lesser flow through the modulating valve 50, and thus the inlet fluid conduit 70 and the first heat exchanger HE1 and the third heat exchanger HE3. In such a situation, less heat is removed from the exhaust at the first heat exchanger HE1, so there is more heat in the exhaust from the ware washing cavity 20 and/or rinse section 22 at the second heat exchanger HE2, and therefore a greater load on the refrigerant recirculation pump 66 of the heat pump 60, resulting in greater head pressure. Because the heat pump 60 works better with the head pressure in a given range, greater efficiency is achieved when the head pressure is controlled to be in the desired range. In the ware washing machine 10 of the present disclosure, this control is achieved by controlling the load on the heat pump 60 by automatically dynamically controlling the amount of incoming water flowing through the inlet fluid conduit 70 by adjusting the modulating valve 50 to control the amount of flow, based on the sensed refrigerant head pressure. Further, changes in environmental conditions, such as the temperature of the incoming water, the ambient temperature, incoming water pressure, and/or the types of wares being washed can all influence the amount of load on the heat pump 60. The use of automatic dynamic control of the flow rate through the inlet fluid conduit 70 allows for efficient operation despite changes in any/all of these variables. Further, the need for follow-up service calls, in order to "tune" the flow rate through the inlet fluid conduit 70 is reduced. In addition, the electronic control of the modulating valve 50 by the processing circuitry 40 allows for optional anticipatory control of the flow setting when changing operating modes, as explained further below.

In some embodiments, the inlet fluid conduit 70 optionally also includes a switching valve assembly 74 receiving inlet water heated by the heat pump 60 and selectively directing the heated inlet water either to the modulating valve 50 or the booster heater 29. In some embodiments the switching valve assembly 74 may be a single valve; in some embodiments, the switching valve assembly 74 may be multiple valves (e.g., a valve manifold). For example, the switching valve assembly have two valves: a discharge valve 74*d* and a rinse valve 74*r*. For such embodiments, it is intended that when the discharge valve 74*d* is open, the rinse valve 74*r* is closed; and when the discharge valve 74*d* is closed, the rinse valve 74*r* is open. Thus, the switching valve assembly 74 conceptually operates as an A/B switch to direct the flow of heated incoming water from the heat pump 60 to either the booster heater 29 or the modulating valve 50. The mode or state of the switching valve assembly 74 is controlled by the processing circuitry 40.

The ware washing machine 10 advantageously has a first operating mode and a second operating mode. In the first operating mode, the switching valve assembly 74 directs the heated inlet water to the modulating valve 50. In the second operating mode, the switching valve assembly 74 directs the heated inlet water to the booster heater 29. The automatic dynamic control of the modulating valve 50 optionally occurs during the first operating mode, but not during the second operating mode. This is because (clean) heated water is directed to the booster heater 29 (by switching valve assembly 74) in the second mode, and water is not flowing through the modulating valve 50 in the second mode, so dynamically adjusting the modulating valve 50 is not beneficial. Additionally, in some embodiments, the processing circuitry 40 is configured to, during the second operating mode, adjust the modulating valve 50 to a predetermined open state prior to entering the first operating mode, but not dynamically adjust the modulating valve 50 based on the sensed head pressure.

In some embodiments, the ware washing machine 10 includes an optional fluid recirculation path 76 between the wash tank 26 and heat pump 60 and back to the wash tank 26. The recirculation path 76 includes a recirculation pump 78 disposed to receive fluid from the wash tank 26 and pump the fluid to a fourth heat exchanger HE4 of the heat pump 60. For example, the fluid recirculation path 76 may include line 87 leading to the heat pump 60, and line 88 leading to the wash tank 26, and the recirculation pump 78. Note that the fluid recirculation path 76 advantageously flows through the fourth heat exchanger HE4, to pull so-called super heat from the refrigerant. In some embodiments, the recirculation path 76 merges with the inlet fluid conduit 70 upstream of the wash tank 26.

In some embodiments, the exhaust air plenum 30 exhausts to ambient via a fan 32 disposed to forcibly exhaust the exhaust air plenum 30 to ambient. In some embodiments, the fan 32 is variably controlled so as to have different air displacement rates.

The ware washing machine 10 may have only one operating mode (e.g., on and washing), or may have a plurality of operating modes. For example, the ware washing machine 10 may have a first operating mode (or "wash" mode), where solution 27 is being sprayed in the washing cavity 20, the heat pump 60 is on, and incoming water is being heated by the first heat exchanger HE1 (or both the first and third heat exchangers HE1, HE3), and the modulating valve 50 is being automatically dynamically controlled by the processing circuitry 40, and the switching valve assembly 74 is set to send inlet water heated by the heat pump 60 to the modulating valve 50. The ware washing machine 10 may also have a second operating mode (or "plus rinse" mode), where solution 27 is being sprayed in the washing cavity 20, the heat pump 60 is on, and incoming water is being heated by the first heat exchanger HE1 (or both the first and third heat exchangers HE1,HE3), but the switching valve assembly 74 is set to send inlet water heated by the heat pump 60 to the booster heater 29, heated water is being supplied to the rinse section 22, and the modulating valve 50 is not being automatically dynamically controlled by the processing circuitry 40. Note that the ware washing machine 10 may transition from the first ("wash") operating mode to the second ("plus rinse") operating mode in response to detecting the presence of a rack in the rinse section 22 (such as in response to a rinse rack presence switch (not shown)). The ware washing machine 10 may optionally also have a "recovery" mode, where the heat pump 60 is on, fan 32 is at or near full speed (to evacuate steam from ware washing cavity 20 and/or rinse section 22 as quickly as possible), and the modulating valve 50 is being automatically dynamically controlled by the processing circuitry 40, but the pumps (not shown) for spraying the solution 27 in the ware washing cavity 20 are not on. The ware washing machine 10 may optionally have other modes, such as an idle mode (heat pump 60 off, but fan 32 running at or near its lowest setting), and/or an idle/heat pump 60 only mode (no spraying solution 27 in the ware washing cavity 20, but heat pump 60 on, and switching valve assembly 74 directing heated incoming water to the modulating valve 50). Note that whenever the heat pump 60 is on, water is flowing through the first heat exchanger HE1 and optionally the third heat exchanger HE3, and being directed either to the modulating valve 50 or the booster heater 29, depending on the setting of the switching valve assembly 74.

As mentioned above, when the ware washing machine 10 of some embodiments transitions from the first ("wash") operating mode to the second ("plus rinse") operating mode, the modulating valve 50 is taken out of the flow path from the first heat exchanger HE1 because the heated incoming water is directed to the booster heater 29 (then to the rinse section 22). However, after the second operating mode, the ware washing machine 10 typically reverts to a mode where the switching valve assembly 74 is directing heated incoming water to the modulating valve 50 (e.g., the wash mode, or the recovery mode, or the idle/heat pump 60 mode). However, the inlet water flow rates in the second ("plus rinse") operating mode versus the other modes are typically substantially different; because of this, the situation of switching out of the second ("plus rinse") operating mode presents challenges for control of the modulating valve 50 immediately after the mode change. As such, in some embodiments, the processing circuitry 40 conceptually anticipates the mode change and adjusts the modulating valve 50 to a predetermined open state prior to leaving the second ("plus rinse") operating mode. This setting to the predetermined open state is advantageously done at or shortly after entry into the second operating mode.

For additional information about aspects of the structure of some embodiments of the ware washing machine 10, such as the ware washing cavity 20, the wash tank 26, the rinse section 22, the heat pump 60, and other aspects excluding the modulating valve 50 and the related aspects of the processing circuitry 40, attention is directed to the series of ware washing machines 10 known as "PRO Series Ventless Heat Recovery Rack Conveyor 24 Dishwashers," available from Champion Industries of Winston-Salem, N.C.

It should be noted that the presence of the heat pump 60 and other features of some embodiments of the ware washing machine 10 advantageously allow the exhaust from the ware washing machine 10 to be vented directly to the ambient environment of the kitchen (or dish cleaning area) without requiring a dedicated vent hood. Because of the heat transfer approach taken in some embodiments, the direct exhaust does not add significant heat/steam to the ambient environment. Thus, some embodiments of the ware washing machine 10 may be considered as "ventless" in the industry.

The discussion above has generally be in the context of heating the incoming water using both the first and third heat exchangers HE1,HE3, but such is not required in all embodiments. In some embodiments, the third heat exchanger HE3 is not used to heat the incoming water, so line 83 83 leads from the first heat exchanger HE1 to the switching valve assembly 74 and/or directly to the modulating valve 50. In some embodiments, the first heat exchanger HE1 is not used to heat the incoming water (and may not be present), so water supply line 82 goes to the third heat exchanger HE3 and line 83 is omitted. Note that use of both the first and third heat exchangers HE1, HE3 to heat the incoming water is believed to be most advantageous.

Figure 6:
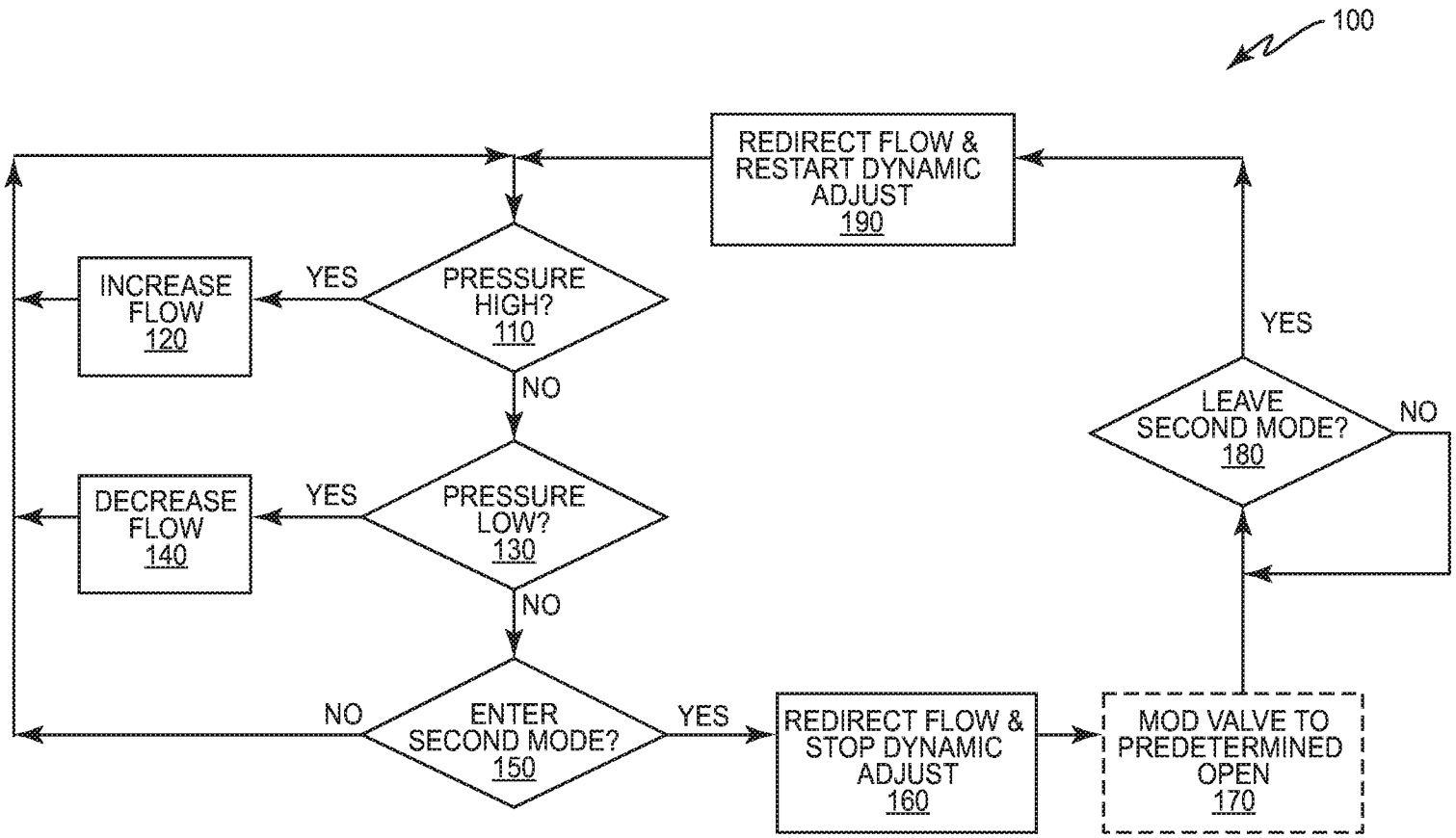
FIG. 6 shows a simplified process flow according to one or more embodiments.

FIG. 6 shows one exemplary process (100) for operating the ware washing machine 10. The process (100) shown in FIG. 6 assumes that incoming water is flowing through second heat exchanger HE2 and/or third heat exchanger HE3, and then to the switching valve assembly 74. At step 110, the processing circuitry 40 checks whether the refrigerant head pressure is too high (e.g., compares to a "high" threshold) based on the pressure sensed by sensor 42. If the pressure is not too high, the process continues to step 130. If the sensed pressure is too high, the processing circuitry 40 causes, at step 120, the modulating valve 50 to open further, in order to increase flow through the modulating valve 50. At step 130, the processing circuitry 40 checks whether the refrigerant head pressure is too low (e.g., compares to a "low" threshold) based on the pressure sensed by sensor 42. If the pressure is not too low, the process continues to step 150. If the sensed pressure is too low, the processing circuitry 40 causes, at step 140, the modulating valve 50 to move to a less open (more closed) position, in order to decrease flow through the modulating valve 50. At step 150, the processing circuitry 40 checks whether the ware washing machine 10 should enter the second ("plus rinse") mode. If not, the process loops back to step 110. If the ware washing machine 10 should enter the second ("plus rinse") mode, the processing circuitry 40, at step 160, causes the switching valve assembly 74 to close the discharge valve 74*d* and open the rinse valve 74*r*, to redirect the heated incoming water to the booster heater 29. In addition, the processing circuitry stops automatically dynamically adjusting (steps 110-140) the modulating valve 50. Optionally, the process (100) continues with the processing circuitry 40 then setting (170) the modulating valve 50 to a predetermined open position in anticipation of resuming flow through the modulating valve 50 at some point in the future when leaving the second mode. At step 180, the processing circuitry 40 checks if the ware washing machine 10 should exit the second mode. If not, the processing circuitry loops back to step 180 to check again. If the ware washing machine 10 should exit the second mode, the processing circuitry 40, at step 190, causes the switching valve assembly 74 to open the discharge valve 74*d* and close the rinse valve 74*r*, to redirect the heated incoming water to the wash tank 26, and restarts automatically dynamically adjusting (steps 110-140) the modulating valve 50. Note that, as can be appreciated, steps 110-120 and 130-140 could be reversed so as reverse the sequence of the low/high pressure checks, as is desired. Note that steps 110-140 are one example of an automatic dynamic adjustment of the modulating valve 50 between a plurality of open states based on the sensed head pressure, so that the head pressure is maintained in a predefined range, based on a simple comparison of a current sensed head pressure value to a low/high threshold. However, other automatic dynamic control approaches of the modulating valve 50 may be used, replacing steps 110-140, such as a proportional-integral-derivative control algorithm based on the sensed head pressure value and past sensed head pressure values, and optionally other operating parameters of the ware washing machine 10.

The discussion above has been in the context of a ware washing machine 10 that employs a conveyor 24 that transports "racks" of wares through the ware washing cavity 20 and through the rinse section 22. Such machines are sometimes referred to in the industry as "rack" or "flight" machines. However, it should be noted that the conveyor 24 is not required in all embodiments, and ware washing machines 10 without a conveyor 24 may employ one or more of the inventive concepts described herein.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

The invention claimed is:

1. A ware washing machine, comprising:

a conveyor;

a ware washing cavity;

a rinse section disposed after the ware washing cavity along the conveyor;

a wash tank;

a heat pump; the heat pump comprising:

a first heat exchanger disposed in an exhaust air plenum leading from the ware washing cavity and operative to remove heat from the exhaust air to heat incoming water;

an evaporator section having a second heat exchanger disposed in the exhaust air plenum downstream of the first heat exchanger, and operative to further remove heat from the exhaust air;

a condensing section; and wherein the heat pump, when operating, has a refrigerant head pressure that varies based on a load placed on the heat pump;

a sensor operative to sense the refrigerant head pressure;

a water supply line for supplying fresh water as the incoming water; the water supply line upstream of the first heat exchanger;

an inlet fluid conduit downstream from the first heat exchanger and leading to the wash tank; wherein the inlet fluid conduit is configured to supply the fresh water to the wash tank without that fresh water being dispensed in the rinse section;

a modulating valve disposed along the inlet fluid conduit and operative to control flow through the inlet fluid conduit; and processing circuitry operatively connected to the sensor and the modulating valve, and is configured to automatically dynamically adjust the modulating valve between a plurality of open states based on the sensed refrigerant head pressure, so that the refrigerant head pressure is maintained in a predefined range.

2. A ware washing machine, comprising:

a booster tank;

a ware washing cavity;

a wash tank;

a heat pump; the heat pump comprising:

a first heat exchanger disposed in an exhaust air plenum leading from the ware washing cavity and operative to remove heat from the exhaust air to heat incoming water;

an evaporator section having a second heat exchanger disposed in the exhaust air plenum downstream of the first heat exchanger, and operative to further remove heat from the exhaust air;

a condensing section; and wherein the heat pump, when operating, has a refrigerant head pressure that varies based on a load placed on the heat pump;

a sensor operative to sense the refrigerant head pressure;

an inlet fluid conduit downstream from the first heat exchanger and leading to the wash tank;

a modulating valve disposed along the inlet fluid conduit and operative to control flow through the inlet fluid conduit; and processing circuitry operatively connected to the sensor and the modulating valve, and is configured to automatically dynamically adjust the modulating valve between a plurality of open states based on the sensed refrigerant head pressure, so that the refrigerant head pressure is maintained in a predefined range;

wherein the inlet fluid conduit comprises a switching valve assembly receiving inlet water heated by the heat pump and directing the heated inlet water either to the booster tank or the modulating valve;

wherein the ware washing machine has a plurality of operating modes, including a first mode and a second mode, and wherein:

in the first mode, the switching valve assembly directs the heated inlet water to the modulating valve;

in the second mode, the switching valve assembly directs the heated inlet water to the booster tank.

3. The ware washing machine of claim 2, wherein the processing circuitry is configured to, during the second mode after being in the first mode, adjust the modulating valve to a predetermined open state prior to re-entering the first mode.

4. The ware washing machine of claim 1, wherein the processing circuitry is configured to dynamically adjust the modulating valve using a proportional-integral-derivative control algorithm.

5. The ware washing machine of claim 1:

further comprising a fluid recirculation path between the wash tank and the heat pump and back to the wash tank;

wherein the recirculation path includes a recirculation pump disposed to receive fluid from the wash tank and pump the fluid to a further heat exchanger of the heat pump.

6. The ware washing machine of claim 1, further comprising a fan disposed to forcibly exhaust the exhaust air plenum to ambient.

7. The ware washing machine of claim 6, wherein the fan is variable speed.

8. The ware washing machine of claim 2:

wherein the ware washing machine further has a third mode;

wherein, in the third mode, the heat pump is operating, incoming water is flowing through the inlet fluid conduit to the wash tank, the modulating valve is being automatically dynamically adjusted between a plurality of open states based on the sensed refrigerant head pressure, and solution is not being sprayed in the ware washing cavity.

9. The ware washing machine of claim 1:

wherein the heat pump further comprises a third heat exchanger disposed downstream the first heat exchanger with regard to incoming water flow; wherein the third heat exchanger is operative to remove heat from recirculating refrigerant of the heat pump to further heat the incoming water;

wherein the third heat pump is disposed in the condensing section of the heat pump.

10. The ware washing machine of claim 9, wherein the heat pump further comprises a fourth heat exchanger associated with a desuperheater of the heat pump, and operative to remove heat from the refrigerant to heat solution recirculated from the wash tank.

11. A method of controlling a ware washing machine according to claim 1; the method comprising:

automatically dynamically adjusting the modulating valve between a plurality of open states based on the sensed head pressure, so that the head pressure is maintained in a predefined range.

12. The method of claim 11:

wherein the ware washing machine further comprises a booster tank; wherein the inlet fluid conduit comprises a switching valve assembly receiving inlet water heated by the heat pump and directing the heated inlet water either to the booster tank or the modulating valve;

wherein the ware washing machine has a plurality of operating modes, including a first mode and a second mode, and wherein:

in the first mode, the switching valve assembly directs the heated inlet water to the modulating valve;

in the second mode, the switching valve assembly directs the heated inlet water to the booster tank;

wherein the processing circuitry is configured to control the switching valve assembly based on which of the plurality of modes the ware washing machine is operating in.

13. The method of claim 12, further comprising adjusting, during the second mode after being in the first mode and prior to re-entering the first mode, the modulating valve to a predetermined open state.

14. The method of claim 11, wherein the automatically dynamically adjusting the modulating valve comprises automatically dynamically adjusting the modulating valve using a proportional-integral-derivative control algorithm.

15. The method of claim 11:

wherein the ware washing machine further comprises a fluid recirculation path between the wash tank and heat pump and back to the wash tank; wherein the recirculation path includes a recirculation pump disposed to receive fluid from the wash tank and pump the fluid to a further heat exchanger of the heat pump;

further comprising pumping fluid along the fluid recirculation path through the further heat exchanger.

16. The method of claim 11, further comprising exhausting air from the washing cavity via the exhaust air plenum by running a fan.

17. The method of claim 11, further comprising conveying wares through the ware washing cavity via the conveyor.

18. The method of claim 11:

further comprising removing heat from the exhaust air to heat the refrigerant at the second heat exchanger.

19. The method of claim 18:

wherein the heat pump further comprises a third heat exchanger associated with a condenser of the heat pump; and further comprising removing heat from the refrigerant to heat the incoming water, downstream the first heat exchanger, at the third heat exchanger.

20. The method of claim 19:

wherein the heat pump further comprises a fourth heat exchanger associated with a desuperheater section of the heat pump; and further comprising removing heat from the refrigerant to heat solution recirculated from the wash tank at the fourth heat exchanger.

* * * * *